US006673522B2

(12) United States Patent
Kim et al.

(10) Patent No.: US 6,673,522 B2
(45) Date of Patent: Jan. 6, 2004

(54) METHOD OF FORMING CAPILLARY DISCHARGE SITE OF PLASMA DISPLAY PANEL USING SAND BLASTING

(75) Inventors: Dae-Il Kim, Rivervale, NJ (US); Steven Kim, Harrington Park, NJ (US)

(73) Assignee: Plasmion Displays LLC, Roanoke, VA (US)

( * ) Notice: Subject to any disclaimer, the term of this patent is extended or adjusted under 35 U.S.C. 154(b) by 114 days.

(21) Appl. No.: 10/095,977

(22) Filed: Mar. 13, 2002

(65) Prior Publication Data

US 2003/0104321 A1 Jun. 5, 2003

Related U.S. Application Data

(60) Provisional application No. 60/335,832, filed on Dec. 5, 2001.

(51) Int. Cl.[7] ..... H01J 9/20

(52) U.S. Cl. ..... 430/321; 430/317; 430/319; 445/24

(58) Field of Search ..... 432/321, 319, 432/317; 313/582, 586; 445/24

(56) References Cited

U.S. PATENT DOCUMENTS 6,255,777 B1 * 7/2001 Kim et al. ..... 313/582
6,428,945 B1 * 8/2002 Lin et al. ..... 430/321
2002/0045396 A1 * 4/2002 Kim ..... 445/24
2002/0058209 A1 * 5/2002 Kim et al. ..... 430/321
2002/0127942 A1 * 9/2002 Kim et al. ..... 445/24

OTHER PUBLICATIONS

Y. Kawai, H. Uchiike, T. Takamori, K. Matsuoka, K. Lin, T. Sasaaki; Hiroshima University, Hiroshima, Japan,; 37.3: High Luminance and High Luminous Efficiency in Barrier–Electrode Color ac Plasma Displays Fabricated by Sand-blasting Technology; SID 95 Digest; pp. 815–818.

T. Hirose, K. Kariya, M. Wakitani, A. Otsuka, T. Shinoda; Fujitsu, Ltd, Kawasaki, Japan; 19.1 Invited Paper: Performance Features of a 42–in.–Diagonal Color Plasma Display; SID 96 Digest; pp. 279–282.

* cited by examiner

*Primary Examiner*—John A. McPherson
(74) *Attorney, Agent, or Firm*—Morgan, Lewis & Bockius LLP

(57) ABSTRACT

A method of fabricating a plasma display panel includes forming one or more electrodes on a substrate, forming a dielectric layer on the first electrode including the substrate, laminating a dry film photoresist on the dielectric layer, patterning the dry film photoresist using a mask, forming one or more capillary discharge sites in the dielectric layer using sand blasting, and removing the patterned dry film photoresist from the substrate. It is emphasized that this abstract is provided to comply with the rules requiring an abstract that will allow a searcher or other reader to quickly ascertain the subject matter of the technical disclosure. It is submitted with the understanding that it will not be used to interpret or limit the scope or meaning of the claims.

9 Claims, 3 Drawing Sheets

METHOD OF FORMING CAPILLARY DISCHARGE SITE OF PLASMA DISPLAY PANEL USING SAND BLASTING

This application claims the benefit of a provisional application, entitled, "Producing Capillary Electrodes Using Sand Blasting", which was filed on Dec. 5, 2001, and assigned Provisional Application No. 60/335,832, which is hereby incorporated by reference.

BACKGROUND OF THE INVENTION

1. Field of the Invention

The present invention relates to a plasma display panel, and more particularly, a method of fabricating a capillary discharge site of a plasma display panel using sand blasting. Although the present invention is suitable for a wide scope of applications, it is particularly suitable for forming a capillary discharge site in the capillary discharge plasma display panel by a reliable and inexpensive process.

2. Discussion of the Related Art

It has been demonstrated that the use of a capillary structure in the dielectric layers of the plasma display panel (PDP) improves device performance in terms of brightness and efficiency. However, one significant issue is the manufacturability of such a structure on a large scale. While experimental samples can be produced by laser drilling, or CNC machining, such processes may not be cost effective in large scale manufacturing environments. The present invention addresses this issue by employing selective sand blasting to form the capillaries into the dielectric layer. The details of the present invention are more fully understood by a discussion of the figure that follows.

SUMMARY OF THE INVENTION

Accordingly, the present invention is directed to a method of forming a capillary discharge site of the plasma display panel using sand blasting that substantially obviates one or more of problems due to limitations and disadvantages of the related art.

Another object of the present invention is to provide a reliable and inexpensive process to form a capillary discharge site in the capillary discharge plasma display panel.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a method of fabricating a plasma display panel includes forming one or more electrodes on a substrate, forming a dielectric layer on the first electrode including the substrate, laminating a dry film photoresist on the dielectric layer, patterning the dry film photoresist using a mask, forming one or more capillary discharge sites in the dielectric layer using sand blasting, and removing the patterned dry film photoresist from the substrate.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention.

In the drawings.

DETAILED DESCRIPTION OF THE ILLUSTRATED EMBODIMENTS

Reference will now be made in detail to the illustrated embodiments of the present invention, examples of which are illustrated in the accompanying drawings. Wherever possible, the same reference numbers will be used throughout the drawings to refer to the same or like parts.

Figure 1:
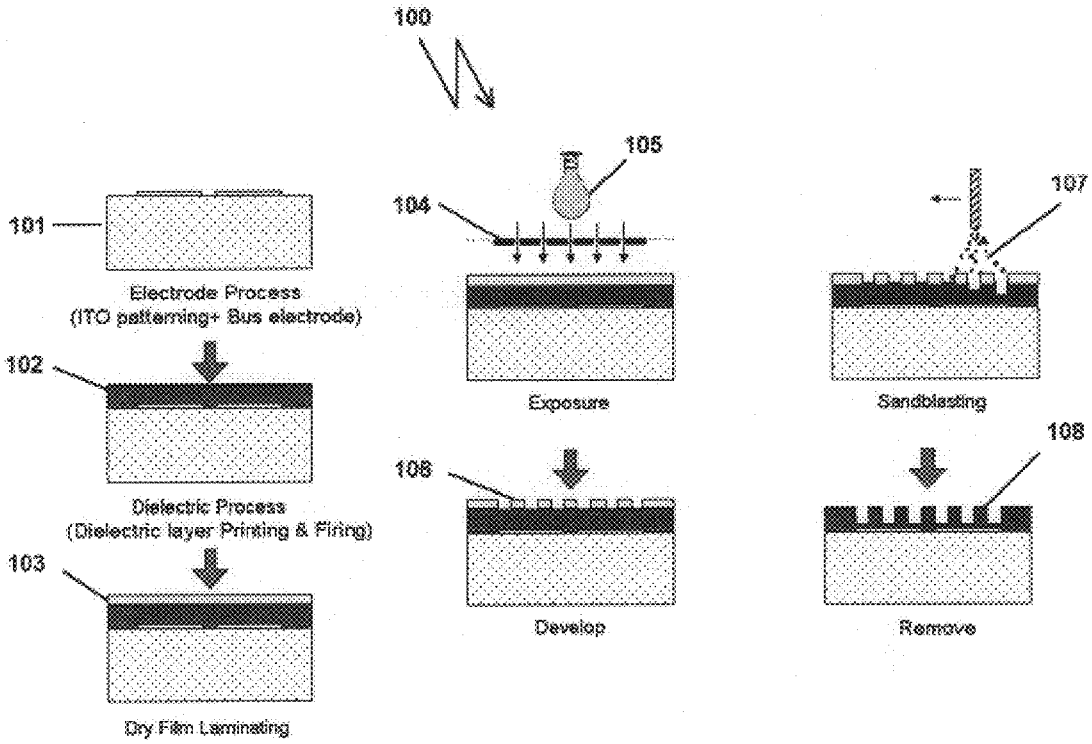
FIG. 1 illustrates a sequence of steps 100 to form one or more capillary discharge sites using sand blasting.

FIG. 1 illustrates the sequence of steps 100 to form one or more capillary discharge sites using sand blasting. The process begins with a set of patterned electrodes and bus structures over a glass substrate 101. The electrodes are then covered with a dielectric layer 102 such as lead oxide (PbO). The PbO layer is then covered with a dry film laminate photoresist 103. The photoresist 103 is then exposed to light 105 through a patterned mask 104 designed to form a desired capillary structure. Such a structure may be, by way of example only, a cylindrical hollow, polygonal or rectangular hollows. After exposure, the film is developed so that the masked pattern 106 appears over the dielectric layer 102. Once the desired pattern is placed on the dielectric layer 102, the surface is sand blasted with fine granular silica or other abrasive materials 107. Since the film material is resistant to the sand blasting, the area over the dielectric layer where the film has been removed is preferentially etched by the impinging particulates. Once the structures are cut to the desired depth, the sand blasting is stopped, and the electrode structure is then treated to remove the remaining photoresist, leaving behind the dielectric layer with the desired capillary discharge sites 108. The electrode structure is then cleaned and prepared for any subsequent processing steps.

Figure 2:
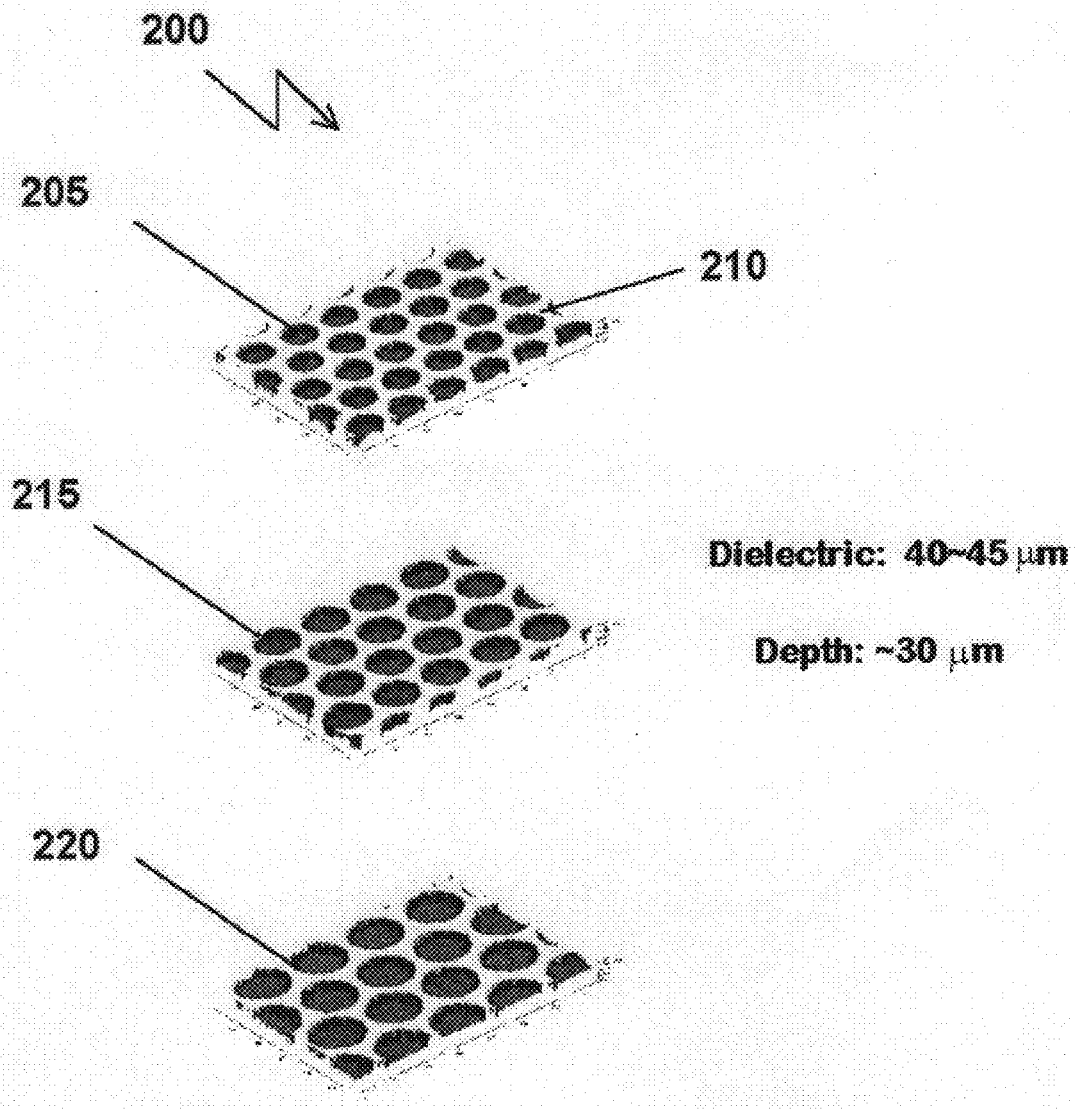
FIG. 2 illustrates a series of microscopic images 200 of the capillary discharge sites formed by the process described by the present invention.

FIG. 2 illustrates a series of microscopic images 200 of actual capillaries formed by the process described by the present invention. In each of the three images, capillaries were cut into an approximately 40 to 45 micron thick layer of PbO 210 at a depth of approximately 30 microns, leaving approximately 10 to 15 microns of PbO at the bottom of the capillaries. The first image illustrates capillaries of 75-micron diameter 205. The second image illustrates capillaries of 100-micron diameter 215. And, the third image illustrates capillaries of 125-micron diameter 220.

Figure 3:
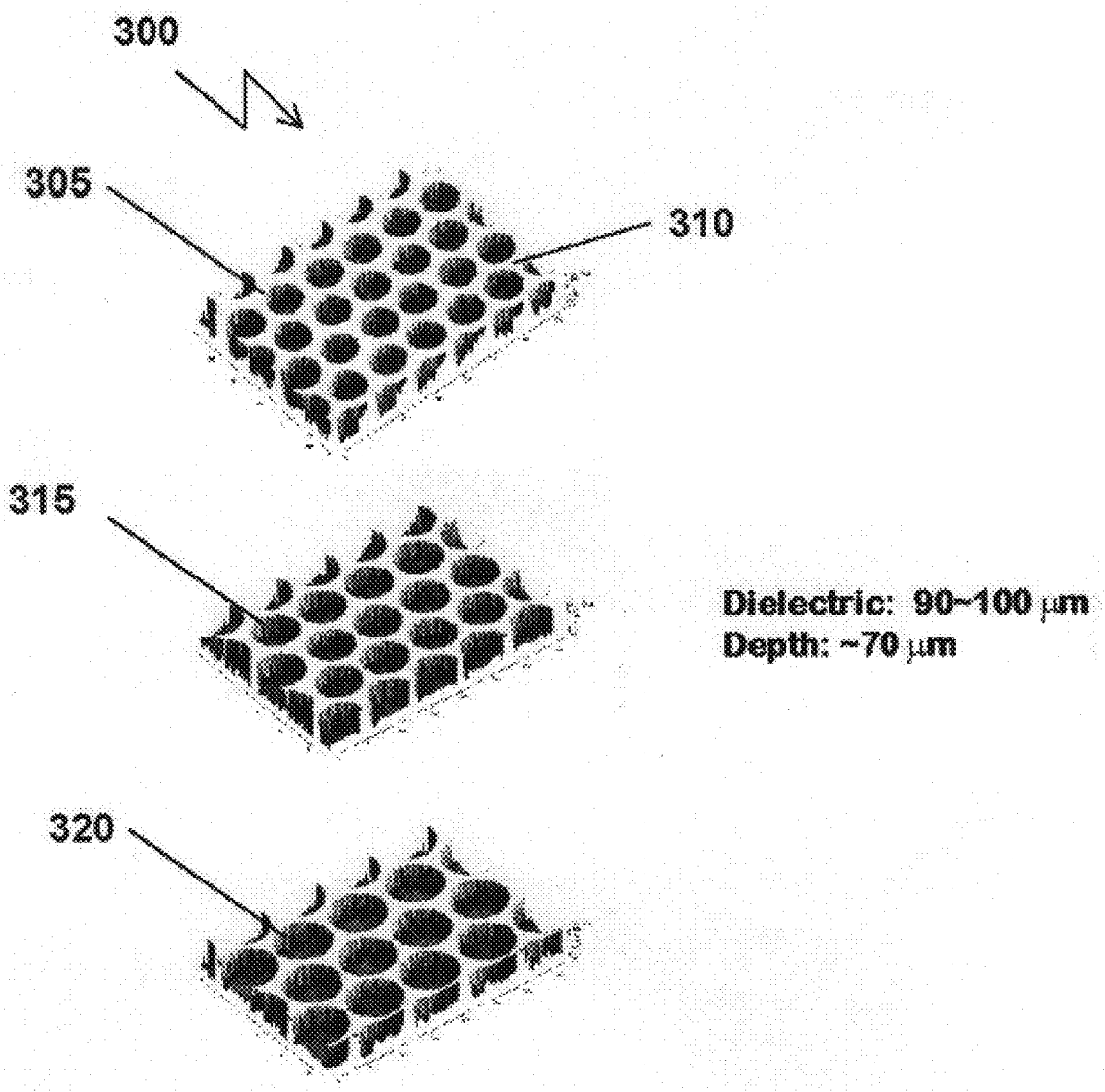
FIG. 3 illustrates a series of microscopic images 300 of the capillary discharge sites formed by the process described by the present invention.

FIG. 3 illustrates a series of microscopic images 300 of actual capillaries formed by the process described by the present invention. In each of the three images, capillary discharge sites were cut into an approximately 100 micron thick layer of PbO 310 at a depth of approximately 70 microns, leaving approximately 30 microns of PbO at the bottom of the capillaries. The first image illustrates capillaries of 75-micron diameter 305. The second image illustrates capillaries of 100-micron diameter 315. And, the third image illustrates capillaries of 125-micron diameter 320.

While specific capillary geometries and dielectric thickness have been discussed herein, they have been provided by way of example only. Many other shapes and sizes are possible and are considered within the scope of the present invention.

It will be apparent to those skilled in the art that various modifications and variations can be made in the method of forming a capillary discharge site of the plasma display panel using sanding blasting of the present invention without departing from the spirit or scope of the inventions. Thus, it is intended that the present invention covers the modifications and variations of this invention provided they come within the scope of the appended claims and their equivalents.

What is claimed is:

1. A method of fabricating a plasma display panel, comprising:

forming one or more electrodes on a substrate;

forming a dielectric layer on the first electrode including the substrate;

laminating a dry film photoresist on the dielectric layer;

patterning the dry film photoresist using a mask;

forming one or more capillary discharge sites in the dielectric layer using sand blasting; and removing the patterned dry film photoresist from the substrate.

2. The method according to claim 1, wherein the dielectric layer includes lead oxide.

3. The method according to claim 1, wherein the capillary discharge sites are formed to have a shape of one of cylindrical, rectangular, and polygonal hollows.

4. The method according to claim 1, wherein the sand blasting is performed with particles of one of silicon carbide, aluminum oxide, and silica.

5. The method according to claim 4, wherein the particles are formed to have an average size of about 10 microns.

6. The method according to claim 1, wherein the capillary discharge sites is formed to have a width in the range of about 75 to 125 microns.

7. The method according to claim 1, wherein the capillary discharge sites are formed to have a depth in the range of about 30 to 70 microns.

8. The method according to claim 1, wherein the electrode is formed to be covered with the dielectric layer having a thickness in the range of about 10 to 30 microns below the capillary discharge sites.

9. The method according to claim 1, wherein the patterning the dry film photoresist using a mask includes, exposing light to the dry film photoresist through the mask and removing the exposed portion of the dry film photoresist.

* * * * *